US005833550A

United States Patent [19]

Chen

[11] Patent Number: 5,833,550

[45] **Date of Patent: *Nov. 10, 1998**

[54] GOLF CLUB HEAD

[75] Inventor: Kuang-Wei Chen, Ping Tung, Taiwan

[73] Assignee: Chien Ting Precision Casting Co., Ltd., Ping Tung, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 794,447

[22] Filed: Feb. 4, 1997

[51] Int. Cl.[6] ..... A63B 53/04

[52] U.S. Cl. ..... 473/324; 473/305

[58] Field of Search ..... 473/305, 324

[56] References Cited

U.S. PATENT DOCUMENTS

| | | | |
|---|---|---|---|
| 3,140,094 | 7/1964 | Hings | 473/305 |
| 3,614,101 | 10/1971 | Hunter | 473/305 X |
| 4,449,707 | 5/1984 | Hayashi et al. | 473/305 X |
| 5,185,914 | 2/1993 | Petruccelli et al. | 473/324 X |
| 5,244,211 | 9/1993 | Lukasiewicz | 473/305 |
| 5,320,347 | 6/1994 | Parente et al. | 473/305 |
| 5,429,358 | 7/1995 | Rigal et al. | 473/305 X |
| 5,435,551 | 7/1995 | Chen | 473/324 X |
| 5,538,246 | 7/1996 | Dekura | 473/305 X |
| 5,575,723 | 11/1996 | Take et al. | 473/305 |
| 5,588,922 | 12/1996 | Schmidt et al. | 473/324 |

FOREIGN PATENT DOCUMENTS

| | | | |
|---|---|---|---|
| 6-269515 | 9/1994 | Japan | 273/167 R |
| 323897 | 1/1930 | United Kingdom | 273/167 R |

*Primary Examiner*—Raleigh W. Chiu
*Attorney, Agent, or Firm*—Rosenburg, Klein & Bilker

[57] ABSTRACT

A golf club head has a body, a face on a front side of the body, and a neck extending upward from a heel. The heel has a wall section that is thicker than that of the neck to lower the center of gravity of the body. A through hole is provided in the neck and the heel for receiving a lower end of a shaft therein. The combination provides a longer hitting force arm for hitting balls a further distance.

1 Claim, 2 Drawing Sheets

GOLF CLUB HEAD

BACKGROUND OF THE INVENTION

This invention relates to a golf club head. More particularly, this invention relates to a golf club head having an elongated hitting force arm for hitting a golf ball a further distance than a conventional golf club can hit the ball.

The structure of a golf club head has an influence on the distance that a golf ball can be hit. A known golf club head, shown in FIGS. 3 and 4, has a body 11 of a properly curved shape and a face 20 on a front side thereof for hitting a ball. The golf club head also has a neck 30 extending upward from a heel portion thereof for a shaft to be fitted firmly in a hole formed therein.

SUMMARY OF THE INVENTION

This invention has been devised to improve the known conventional golf club head. In the present invention an upwardly extending integrally formed cylindrical portion extends to a neck, so as to lengthen a hitting force arm to cause a ball to fly further than achieved with conventional golf clubs.

BRIEF DESCRIPTION OF DRAWINGS

This invention will be better understood by referring to the accompanying drawings, wherein.

DESCRIPTION OF THE PREFERRED EMBODIMENT

Figure 1:
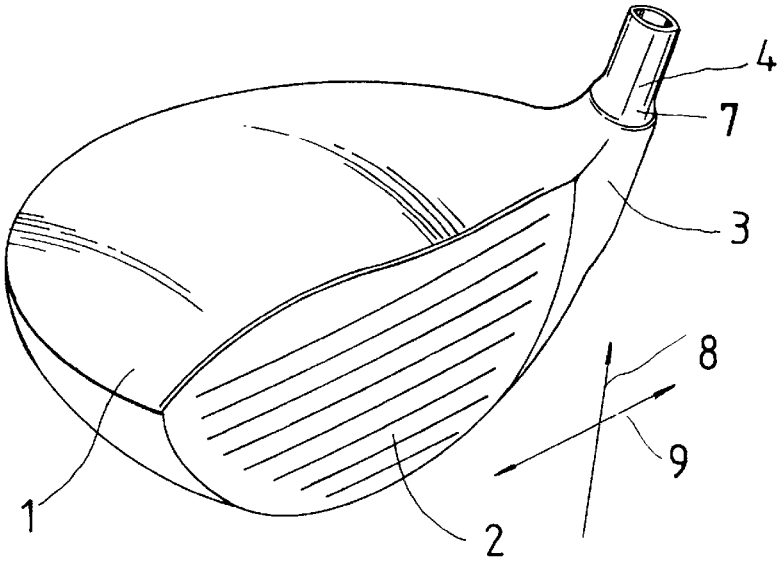
FIG. 1 is a perspective view of a preferred embodiment of a golf club head of the present invention.
Figure 2:
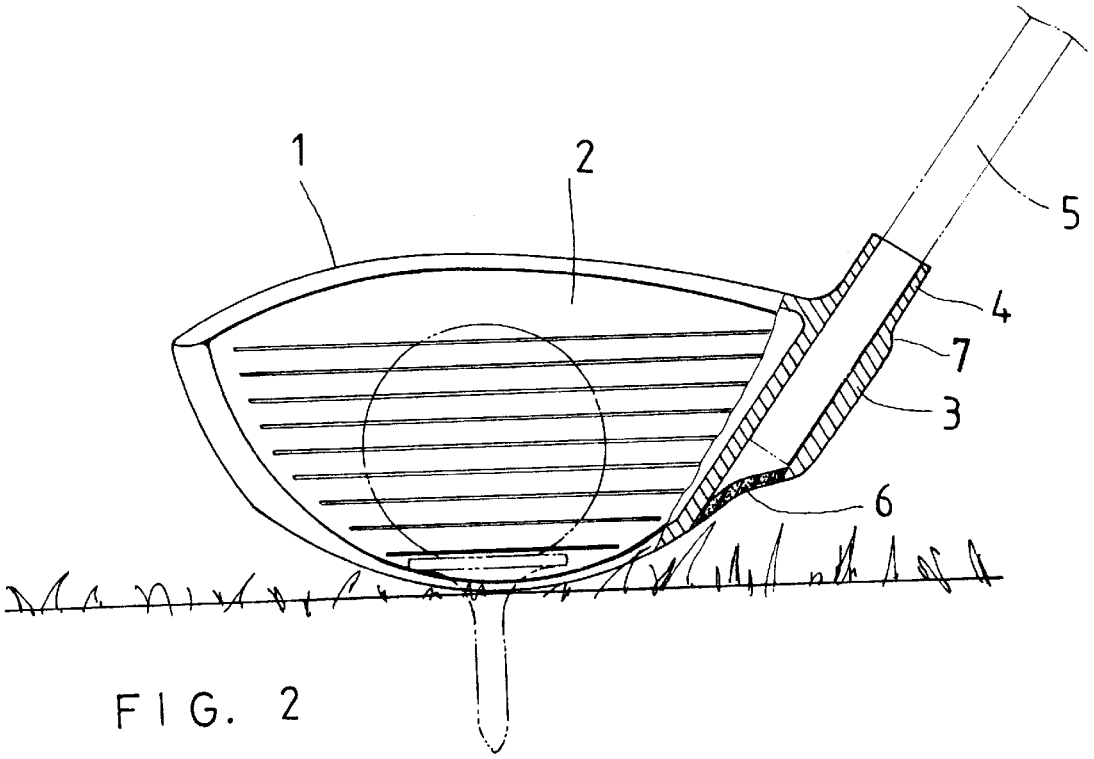
FIG. 2 is a side elevation view, partially cut away, of the preferred embodiment of a golf club head of the present invention.
Figure 3:
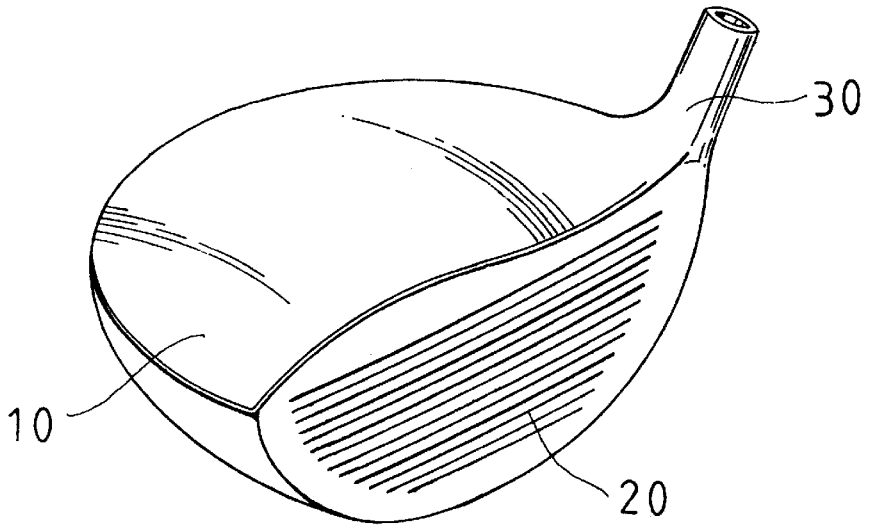
FIG. 3 (PRIOR ART)
FIG. 3 is a perspective view of a known conventional golf club head.
Figure 4:
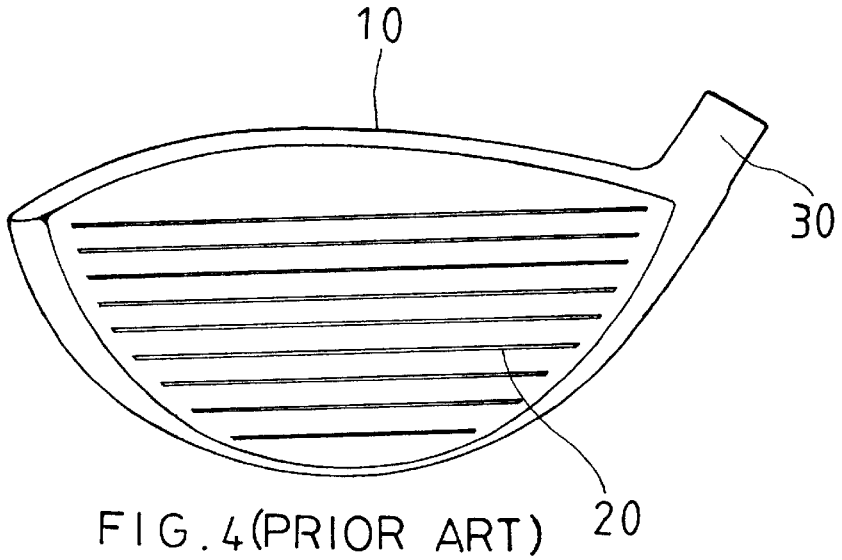
FIG. 4(PRIOR ART)
FIG. 4 is a side elevation view of the known conventional golf club head.

A preferred embodiment of a golf club head of the present invention, as shown in FIGS. 1 and 2, has a body 1 of properly curved shape. A face 2 is formed on a front side of the body 1 for hitting a ball. The body 1 has a heel 3 and a neck 4 with a through hole formed therein for a lower end of a shaft 5 to be firmly received therein. The neck 4 extends upwardly from an upper side of the body 1 in a longitudinal direction 8. The heel 3 protrudes in a lateral direction 9 and has a thicker wall section than that of the neck 4, with a shoulder 7 disposed therebetween so as to lower the center of gravity of the head. The through hole has its bottom end closed with a stop 6.

In use, the head can hit a ball further than a conventional golf club, because a hitting force arm of the head is longer than that of the conventional golf club head.

In addition, the stability of the head for hitting a ball is augmented in the present invention by the lowered center of gravity, providing a greater degree of stability than the conventional golf club.

While the preferred embodiment of the invention has been described above, it will be recognized and understood that various modifications may be made therein and the appended claims are intended to cover all such modifications which may fall within the spirit and scope of the invention.

I claim:

1. A golf club head comprising:

a body having a curved shape, said body having (a) a face portion formed in a front side thereof for striking a ball therewith, (b) a heel portion formed on one end of said body to protrude in a lateral direction, (c) a neck portion extending in a longitudinal direction, and (d) a shoulder portion extending between said heel and neck portions, said body having a through bore extending through both said neck and heel portions and having a substantially constant diameter for receiving a substantially constant diameter end portion of a shaft therein, said heel portion of said body having a wall thickness that is greater than a wall thickness of said neck portion for lowering a center of gravity of said golf club head; and, a stop member disposed in a lower end of said through bore for forming a closure therefor.

* * * * *